United States Patent [19]

Ikeura et al.

[11] 4,173,956

[45] Nov. 13, 1979

[54] CLOSED LOOP FUEL CONTROL IN ACCORDANCE WITH SENSED ENGINE OPERATIONAL CONDITION

[75] Inventors: Kenji Ikeura; Masaaki Saito, both of Yokosuka; Michiyoshi Yamane, Tokyo, all of Japan

[73] Assignee: Nissan Motor Company, Limited, Japan

[21] Appl. No.: 852,352

[22] Filed: Nov. 17, 1977

[30] Foreign Application Priority Data

Nov. 30, 1976 [JP] Japan ..... 51-144491

[51] Int. Cl.[2] ..... F02M 7/14

[52] U.S. Cl. ..... 123/119 EC; 60/276

[58] Field of Search ..... 123/119 EC; 60/276, 60/285

[56] References Cited

U.S. PATENT DOCUMENTS

| | | | |
|---|---|---|---|
| 3,827,237 | 8/1974 | Linder et al. | 60/276 |
| 3,831,564 | 8/1974 | Schmidt et al. | 60/285 |
| 3,906,910 | 9/1975 | Szlaga, Jr. | 60/276 |
| 3,939,654 | 2/1976 | Creps | 60/285 |
| 4,023,357 | 5/1977 | Masaki | 60/276 |
| 4,026,256 | 5/1977 | Fenn | 123/119 EC |
| 4,029,061 | 6/1977 | Asano | 60/285 |
| 4,046,118 | 9/1977 | Aono | 123/119 EC |
| 4,057,042 | 11/1977 | Aono | 123/119 EC |
| 4,083,337 | 4/1978 | Hattori et al. | 123/119 EC |
| 4,089,313 | 5/1978 | Asano et al. | 123/119 EC |

FOREIGN PATENT DOCUMENTS

| | | | |
|---|---|---|---|
| 2349533 | 4/1974 | Fed. Rep. of Germany | 60/276 |
| 2547141 | 4/1976 | Fed. Rep. of Germany | 123/119 EC |
| 2549388 | 5/1976 | Fed. Rep. of Germany | 123/119 EC |
| 2549887 | 5/1976 | Fed. Rep. of Germany | 123/119 EC |
| 2553679 | 6/1976 | Fed. Rep. of Germany | 123/119 EC |

*Primary Examiner*—Charles J. Myhre
*Assistant Examiner*—R. A. Nelli
*Attorney, Agent, or Firm*—Lane, Aitken & Ziems

[57] ABSTRACT

An engine operational condition detector detects a mode among several modes, such as an idling state, a steady state and an accelerating state, where a signal is utilized for selectively actuating one of several integrators, each of which has a predetermined time-constant. One of the integrators, when actuated, integrates an output signal of a P-I controller of a closed loop fuel control system, the integrated signal being stored in a capacitor connected across the integrator. Electromagnetic valves disposed in the openings of main air-bleeds of main and slow circuits of a carburetor are energized in accordance with the output signal of each integrator while other electromagnetic valves disposed in the openings of auxiliary air-bleeds of the same are energized in dependence on the output signal of the P-I controller.

9 Claims, 6 Drawing Figures

EXHAUST GAS
ALARM DEVICE
ALARM SIGNAL GENERATOR
SAW TOOTH WAVE SIGNAL GENERATOR
REFERENCE SIGNAL α1
REFERENCE SIGNAL α2
REFERENCE SIGNAL α3
REFERENCE SIGNAL α4
REFERENCE SIGNAL

CLOSED LOOP FUEL CONTROL IN ACCORDANCE WITH SENSED ENGINE OPERATIONAL CONDITION

FIELD OF THE INVENTION

The present invention generally relates to a closed loop fuel control system for an internal combustion engine, and more specifically to a closed loop fuel control system which provides a feed back control in response to the concentration of a component of the exhaust gas in accordance with the engine operational condition.

BACKGROUND OF THE INVENTION

In a conventional closed loop fuel control system, a gas sensor is utilized to detect the concentration of a component of the exhaust gas where the gas sensor indicates the instantaneous air/fuel ratio of the air and fuel mixture supplied to the combustion engine. At least one electromagnetic valve disposed in an air-bleed of a carburetor controls the opening of the air-bleed in response to a control signal obtained by using a signal from the gas sensor and thus controls the air/fuel ratio. Also in an injection system, such a feed back system in which the fuel flow rate is controlled is proposed.

This closed loop fuel control system is mainly used for obtaining the maximum efficiency of a three-way catalytic converter interposed in the exhaust passage by maintaining a desired air/fuel ratio (as an example, in the vicinity of the stoichiometric air/fuel ratio). However, the carburetor system has a tendency to have a deviation between the actual characteristics of the fuel flow rate and the required one as shown in FIG. 1. This deviation is so large that it can not be ignored and the amount of the deviation varies in accordance with the condition of the engine operation.

In order to compensate this deviation the control range of the conventional closed loop fuel control system had to be designed very wide corresponding to such a large error. The above-mentioned control range may be represented by an ON/OFF rate of a valve provided to selectively open an air-bleed of a carburettor. FIG. 2 shows a typical valve ON/OFF rate of a conventional closed loop fuel control system at various engine operational conditions. As shown in this figure, the valve ON/OFF rate, i.e. the control range, widely varies in accordance with the engine operational conditions. When the engine operational conditions are changed, for example from an idling state to an accelerating state, the valve ON/OFF rate is suddenly changed from a very low rate to a high rate.

When the control range of the correction is made large for providing an adequate feed back control by using an ON-OFF type of an electromagnetic valve as described, the difference between the richest and the leanest air/fuel ratio becomes considerably large and this large difference may cause a hunting phenomenon of the internal combustion engine.

As shown in FIG. 2, time delays occur at the transient state between two different engine operational conditions. The delay times are denoted by $\Delta t_1$, $\Delta t_2$, $\Delta t_3$ in the figure. These delay times are undesirable for obtaining high responsive characteristics.

SUMMARY OF THE INVENTION

The present invention overcomes these above-mentioned drawbacks of the conventional type of a closed loop fuel control system. The basic idea of the present invention is to provide an improved closed loop fuel control system in which the original characteristic of the fuel flow rate is modified toward the required one as shown in FIG. 3. Since the original characteristic provides a higher fuel flow rate and a lower fuel flow rate with respect to the required one in accordance with engine operational conditions, the amount of modification is determined differently in various engine operational conditions. The modification of the fuel flow rate in accordance with engine operational conditions provides a rough or coarse control of the air/fuel ratio. To detect the engine operational conditions, an intake air flow rate may be used as shown in FIG. 3. After the fuel flow rate characteristic is modified as described above, the control range may be reduced to a small one. Consequently, the valve ON/OFF rate does not vary in various engine operational conditions and preferably stays at or around the 50% line as shown in FIG. 5.

Therefore a primary object of the present invention is to provide an improved closed loop fuel control system which has a high responsive characteristic at the transient states of engine operational conditions.

Another object of the present invention is to provide such a system which leads to a stable operation of the engine.

A further object of the present invention is to provide such a system in which the correction of the air/fuel ratio of the mixture is performed in a short period of time for maintaining the desired air/fuel ratio optimum to the maximum efficiency of a three-way catalytic converter.

BRIEF DESCRIPTION OF THE DRAWINGS

These and other objects and features of the invention will become more readily apparent from the following detailed description taken in conjunction with the accompanying drawings in which.

DETAILED DESCRIPTION OF THE PREFERRED EMBODIMENT

Figure 4:
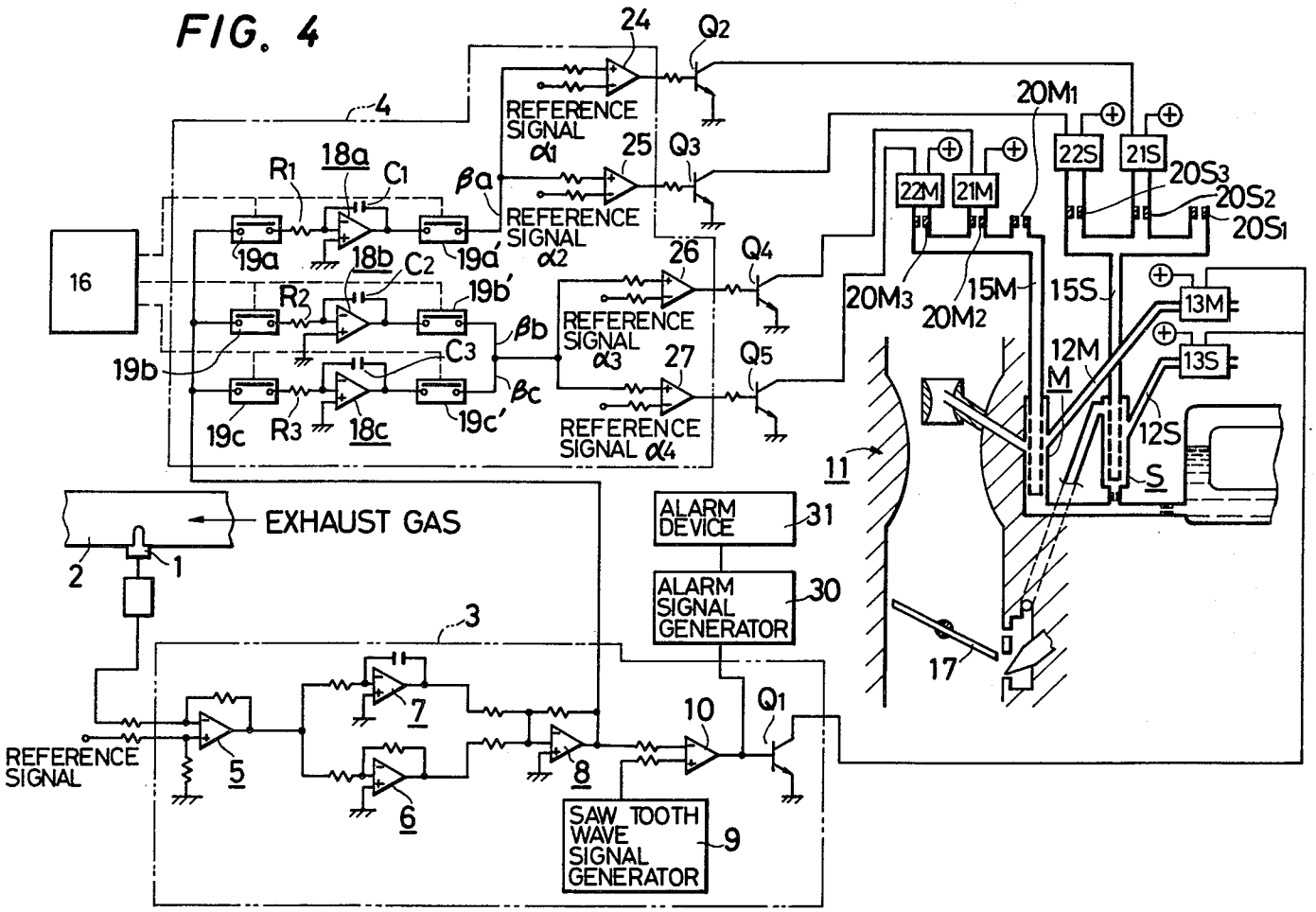
FIG. 4 is a circuit diagram of a preferred embodiment of an improved closed loop fuel control system according to the present invention.

Reference is now made to FIG. 4. A gas sensor 1 such as an $O_2$ sensor is provided in an exhaust gas passage 2 for detecting the air/fuel ratio of the air and fuel mixture supplied to an internal combustion engine. A control circuitry 3 is provided for controlling electromagnetic valves 13M, 13S equipped on each auxiliary air-bleed 12M, 12S of main and slow circuits M, S of a carburetor for maintaining the stoichiometric air/fuel ratio by using an output signal of the $O_2$ sensor 1. The control circuitry 3 includes a difference signal generator 5, a proportional amplifier 6, an integrator 7, an adder 8, a sawtooth wave signal generator 9, a comparator 10 and a transistor $Q_1$.

The output signal of the $O_2$ sensor 1 is supplied via a resistor to an input of the difference signal generator 5 while the other input of the same is fed with a reference signal the magnitude of which represents the stoichiometric air/fuel ratio. The difference signal generator 5 generates a signal representative of a deviation of the instantaneous air/fuel ratio from the stoichiometric one at its output. The output signal of the difference signal generator 5 is then fed to both the proportional amplifier 6 and the integrator 7 to be proportionally amplified and integrated respectively. The amplified signal and the integrated signal are summed thus superposed in the adder 8. The added signal is then supplied to an input of the comparator 10 while the other output of the same is fed with a sawtooth wave signal generated by the sawtooth wave signal generator 9. The comparator 10 produces a pulse signal at its output terminal when the magnitude of the sawtooth wave signal is greater than the magnitude of the added signal fed from the adder 8. The output of the comparator 10 is coupled with the base of the transistor $Q_1$ and when the pulse signal is generated by the comparator 10, the transistor $Q_1$ becomes conductive. A pair of electromagnetic valves 13M, 13S are connected to the collector of the transistor $Q_1$ thus being energized when the transistor is conductive. When energized, the electromagnetic valves respectively open the openings of the auxiliary air-bleeds 12M, 12S of the main and slow circuits.

The $O_2$ sensor 1, the control circuitry 3 and the pair of valves 13M, 13S constitute a closed loop fuel control system and in this system the main air-bleeds 15M, 15S of main and slow circuits M, S are respectively controlled by electromagnetic valves 21M, 22M, 21S, 22S. These electromagnetic valves are controlled by a modification circuitry 4 in accordance with the engine operational condition. Since the control range of the main air-bleeds is relatively larger than that of the auxiliary air-bleeds, the rough or coarse control of the fuel flow rate is performed by the modification circuitry 4 and the fine control of the same is by the control circuitry 3.

The modification circuitry 4 generates signals, with which the electromagnetic valves equipped on the openings of main air-bleeds are energized, in response to the output signal of the adder 8 of the control circuitry 3 in accordance with the engine operational condition. The engine operational condition is divided into several modes, and in this embodiment, into three modes where the engine operational condition is detected by way of sensing the opening angle of a throttle valve 17. The engine operational condition detector 16 is provided for detecting the opening angle of the throttle valve 17 and thus produces a signal representative of one of the three modes. However, some other engine parameters such as engine rotational speed and the intake air vacuum may be used. In this embodiment the engine operational condition is divided into an idling state, an accelerating state and a steady state of the engine operation. The engine operational condition detector 16 detects the condition and generates a signal indicative of idling state, accelerating state and a steady state when the opening angle $\theta$ of the throttle valve 17 is $\theta=0$, $\theta \geqq 50°$ and $0<\theta<50°$ respectively.

The modification control circuitry 4 is provided for selectively opening the electromagnetic valves 21M, 22M, 21S, 22M of main air-bleeds 15M, 15S in response to the output signal of the adder 8 in a different manner in accordance with the above-mentioned three engine operational conditions. The modification control circuitry 4 includes three integrators **18*a*, 18*b*, 18*c* equipped with input switches 19*a*, 19*b*, 19*c* and output switches 19*a*', 19*b*', 19*c*' and four comparators 24, 25, 26, 27. Each integrator which consists of an operational amplifier (no numeral) has an input resistor $R_1$, $R_2$, $R_3$ and a feedback capacitor $C_1$, $C_2$, $C_3$ where the input resistor is connected via the input switch to the output terminal of the adder 8. The output terminal of the integrator 18*a* is coupled via the output switch 19*a* and a pair of resistors with each input port of comparators 24, 25**.

The engine operational condition detector 16 produces an output signal which selectively closes the three pairs of switches. The schematic connection of the engine operational condition detector 16 and these switches is shown by dotted lines in FIG. 4. When the engine operational condition detector 16 detects an idling state, only the pair of switches **19*a*, 19*a*' close simultaneously and, when an accelerating state, only the pair of switches 19*b*, 19*b*' close and, when steady a state, only the pair of switches 19*c*, 19*c*'** close. With this arrangement only one integrator is actuated corresponding to the beforementioned engine operational condition.

In idling operation, the pair of switches **19*a*, 19*a*' close so that the integrator 18*a* starts to integrate the output signal of the adder 8 where the integrated signal produced by the integrator 18*a* is applied to the pair of comparators 24, 25 while a pair of reference signals are respectively fed to each comparator. The magnitude of the reference signal fed to the comparator 24 is denoted by $\alpha_1$ and the same to the other comparator 25** is by $\alpha_2$. Each comparator produces an output signal when the magnitude of the integrated signal is greater than the magnitude $\alpha_1$, $\alpha_2$ of each reference signal. It is to be noted that the magnitudes $\alpha_1$ and $\alpha_2$ have following relationship.

$$\alpha_1<\alpha_2$$

In accelerating operation, the integrator **18*b* integrates the output signal of the adder 8 and in a steady state operation, the integrator 18*c* integrates in the same manner. The output terminals of the integrators 18*b*, 18*c* are coupled with each other through the output switches 19*b*', 19*c*' and further connected to input terminals of both comparators 26, 27. The other input of each comparator 26, 27 is fed with a pair of reference signals the magnitudes of which are denoted by $\alpha_3$, $\alpha_4$. The function of these comparators is the same as those of 24, 25**. The magnitudes $\alpha_3$, $\alpha_4$ of reference signals have following relationship:

$$\alpha_3<\alpha_4$$

Assuming respectively the magnitudes of the output signals of the integrators **18*a*, 18*b*, 18*c* as $\beta$a, $\beta$b, $\beta$c, the comparator 24** produces its output signal when;

$$\beta a>\alpha_1$$

the comparator 25 produces its output signal when;

$$\beta a > \alpha_2$$

the comparator 26 produces its output signal when;

either $$\beta b > \alpha_3$$

or $$\beta c > \alpha_3$$

and the comparator 27 produces its output signal when;

either $$\beta b > \alpha_4$$

or $$\beta c > \alpha_4$$

The output signal of each comparator 24, 25, 26, 27 is respectively fed to each base of transistors $Q_2$, $Q_3$, $Q_4$, $Q_5$ while the collector and the emitter of the same is respectively connected to electromagnetic valves 21M, 22M, 21S, 22S and the ground. Therefore each transistor $Q_2$ to $Q_5$ energizes a corresponding electromagnetic valve in response to the signal supplied to the base thereof from each comparator.

For convenience and better understanding a table which shows the relationship of actuation of these electromagnetic valves and the magnitude of the integrated signals is made. In the table "C" stands for the closed state.

| ENGINE OPERATIONAL CONDITION | MAGNITUDE OF INTEGRATED SIGNAL | STATE OF VALVES | | | |
|---|---|---|---|---|---|
| | | SLOW CIRCUIT | | MAIN CIRCUIT | |
| | | VALVE 21S | VALVE 22S | VALVE 21M | VALVE 22M |
| | $\beta a < \alpha_1$ | C | C | C | C |
| IDLING | $\alpha_2 < \beta a < \alpha_2$ | OPEN | C | C | C |
| | $\alpha_2 < \beta a$ | OPEN | OPEN | C | C |
| | $\beta b < \alpha_3$ | C | C | C | C |
| ACCELERATING | $\alpha_3 < \beta b < \alpha_4$ | C | C | OPEN | C |
| | $\alpha_4 < \beta b$ | C | C | OPEN | OPEN |
| | $\beta c < \alpha_3$ | C | C | C | C |
| STEADY STATE | $\alpha_3 < \beta c < \alpha_4$ | C | C | OPEN | C |
| | $\alpha_4 < \beta_c$ | C | C | OPEN | OPEN |

As mentioned before, electromagnetic valves 21M, 22M, 21S, 22S are disposed on each opening of main air-bleeds where the main air-bleed 15M of the main circuit M has three independent openings which respectively have orifices 20M$_1$, 20M$_2$, 20M$_3$ while the other air-bleed 15S of the slow circuit S also includes three independent openings which are respectively equipped with orifices 20S$_1$, 20S$_2$, 20S$_3$ as shown in FIG. 4. Each one opening which is respectively equipped with orifices 20M$_1$, 20S$_1$ among these three openings of each circuit is always open to the atmosphere without electromagnetic valves. Other openings equipped with electromagnetic valves are not free to the atmosphere while the valves are not energized. Since these valves 21M, 22M, 21S, 22S open upon energization, the number of openings of each air-bleed 15M, 15S of each circuit M, S may be selectively controlled. This means the total area of the openings of each air-bleed 15M, 15S is controlled in a manner of three stages as shown in the table. With the arrangement of this control of openings of the air-bleeds, the quantity of the fuel supplied to the intake pipe may be regulated to control the air/fuel ratio of the air and fuel mixture.

Figure 3:
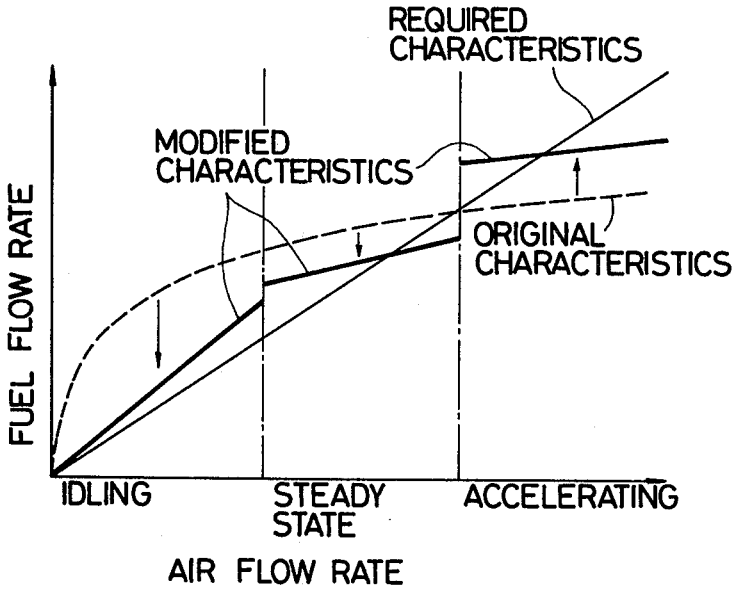
FIG. 3 is an explanatory co-ordinate diagram which shows the relation between the intake air flow rate and the roughly modified fuel flow rate of a carburetor which is controlled by an improved closed loop fuel control system according to the present invention.

The total area of the openings of main air-bleed 15M is considerably larger than that of the auxiliary air-bleed 13M in the main circuit M and the same arrangement is made for the slow circuit S. Therefore it will be understood that the control of openings of main air-bleeds 15M, 15S of each main and slow circuit M, S provides a rough or coarse control of the flow rate of the fuel with respect to the control of the auxiliary air-bleeds 13M, 13S of each circuit for modifying the original characteristics of the fuel flow rate provided by the carburetor 11. This coarse control of the fuel flow rate is performed as shown in FIG. 3 in which the thick lines indicate the fuel flow rate after the modification.

Figure 1:
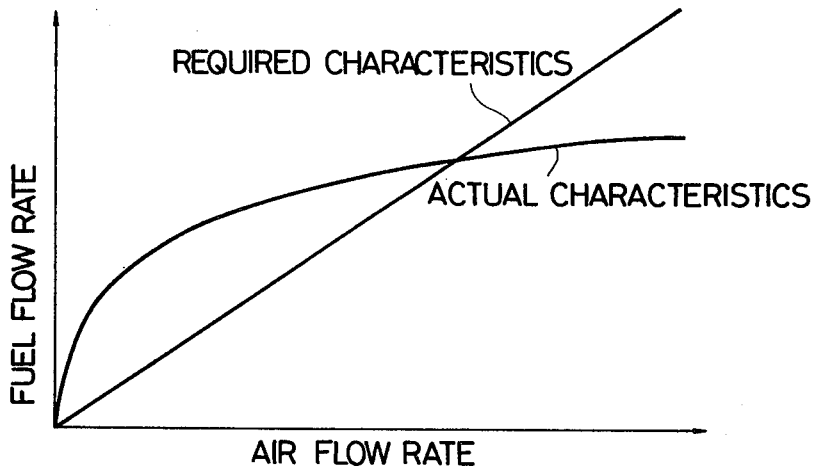
FIG. 1 PRIOR ART
FIG. 1 is a co-ordinate diagram which shows the relation between the intake air flow rate and the fuel flow rate of a carburetor which is not controlled by any closed loop fuel control systems.
Figure 2:
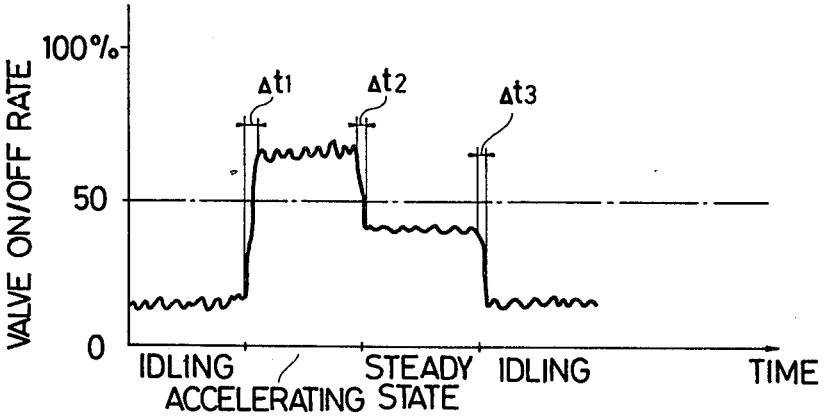
FIG. 2 PRIOR ART
FIG. 2 is a graph which shows the valve ON/OFF rate of a conventional closed loop fuel control system in various engine operational conditions.
Figure 5:
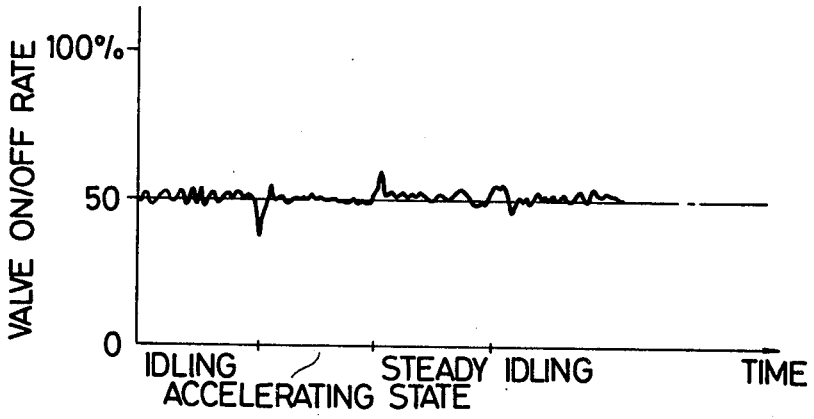
FIG. 5 is a graph which shows the valve ON/OFF rate of the improved closed loop fuel control system in various engine operational conditions.

Reference is now made to FIG. 5 which shows the variation of the required valve operating rate of the closed loop fuel control system according to the present invention. Since the main air-bleeds of each main and slow circuits M, S are controlled in accordance with the engine operational condition, the operating rate of electromagnetic valves 13M, 13S of the auxiliary air-bleeds of the same is considerably small with respect to the one of conventional type which is shown in FIG. 2. It is to be appreciated that the valve operating rate is adjacent to the 50% line thereof in all engine operational conditions.

Figure 6:
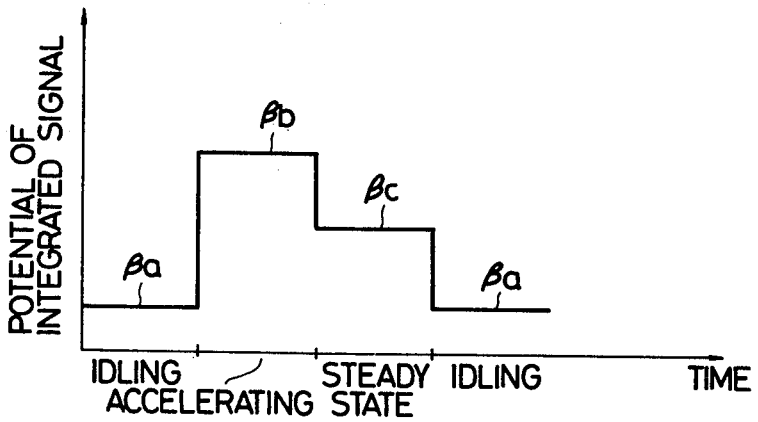
FIG. 6 is a graph which shows the potential of integrated signals produced in the improved closed loop fuel control system.

Reference is now made to FIG. 6 which shows the magnitudes or potentials $\beta a$, $\beta b$, $\beta c$ of integrated signals obtained by integrators 18*a*, 18*b*, 18*c*. The potentials shown in FIG. 6 are obtained when the modification control circuitry 4 is included in a closed loop fuel control system in which the valve operating rate is such as shown in FIG. 2. The electromagnetic valves 21M, 22M, 21S, 22S of main and slow air-bleeds are actuated in response to the potential of the integrated signal as described before. Therefore the modification of fuel flow rate is performed to compensate the deviation of a required valve operating rate. In other words, the characteristics of valve operating rate shown in FIG. 2 is now changed by the modification control circuitry 4 to the characteristics shown in FIG. 5.

Turning back to FIG. 4, the magnitudes $\alpha a$, $\alpha b$, $\alpha c$ of each integrated signal is respectively determined by the time constant of each integrator 18*a*, 18*b*, 18*c* where each integrator may have a different time constant which is determined by the resistance and capacitance of each resistor $R_1$, $R_2$, $R_3$, and capacitor $C_1$, $C_2$, $C_3$ connected thereto.

When the engine operational condition is changed from one to another, for example from idling state to accelerating state, switches 19*a*, 19′ are opened simultaneously and thus switches 19*b*, 19*b*′ close. The signal which has been supplied from the adder 8 is maintained as a charge in the capacitor $C_1$ even after the pair of switches 19a, 19a' is opened. This charge stored in the capacitor $C_1$ is held until the switches close again. Namely, the integrator 18a holds the magnitude of the output signal of the adder 8. Therefore when switches 19a, 19a' close again the integrator 18a provides the charged potential to the corresponding comparators 24, 25.

Because of this stored charge, even after the control circuitry 3 becomes out of order, the integrator 18a is able to provide its output signal to the pair of comparators 24, 25. This output signal is utilized to prevent a sudden change of air/fuel ratio when a control circuitry 3 failure happens, while an alarm signal is issued from an alarm device 31 connected via an alarm signal generator 30 to the output of the comparator 10 of the control circuitry 30 to the output of the comparator 10 of the control circuitry 3 as shown in FIG. 4.

If the engine operational condition does not change for a while and the air/fuel ratio is maintained at desired level, i.e. when the valve operating rate is at 50%, the output signal of the adder 8 does not change from a constant level with which none of the integrators produces its output signal and thus the modification control circuitry 3 does not produce any signal.

The preferred embodiment described hereinthrough is utilized for a carburetor system of an internal combustion engine but the concept of the invention may be adapted to an injection system. In an injection system, the intake air flow rate is detected by a detector such as an air flow meter where the detector sometimes produces a signal which does not represent the air flow rate correctly. It is possible to improve the response time and the stability of the feed back control system by modifying the detected air flow rate in accordance with engine operational conditions. The correction of air/fuel ratio is not limited to the correction of the output signal of the air flow meter since the purpose of the adaption is to make the actual characteristics of fuel flow rate approach the required one.

What is claimed is:

1. A closed loop fuel control system for an internal combustion engine including means for supplying an air/fuel mixture to said engine, comprising:

(a) first means for sensing the concentration of a component contained in the exhaust gases emitted from said engine to produce a first signal indicative of the air/fuel ratio of the air/fuel mixture;

(b) second means for producing a second signal indicative of the difference in magnitude between said first signal and a reference signal;

(c) third means for producing a third signal in response to said second signal, said third means including a proportional-integral controller;

(d) fourth means for producing a control signal in accordance with said third signal;

(e) fifth means for controlling the fuel flow rate in accordance with said control signal;

(f) sixth means for detecting the operational conditions of said engine in accordance with engine parameters, said sixth means producing a fourth signal indicative of an engine operational mode by selecting one from a plurality of modes which are predetermined;

(g) a plurality of integrators;

(h) seventh means for selectively supplying said third signal to one of said integrators in accordance with said fourth signal;

(i) eighth means for holding integrated voltages of the remaining integrators which are supplied with no signal from said seventh means until each of said integrators is supplied with said third signal, each of said integrators integrating said third signal from the level of the holding voltage;

(j) ninth means for producing a second control signal by comparing each output signal of said integrators in magnitude with a plurality of reference signals;

(k) tenth means for selectively supplying each output of said integrators to said ninth means in accordance with said fourth signal; and (l) eleventh means for controlling the fuel flow rate in accordance with said second control signal, the fuel flow rate being roughly controlled by said eleventh means, while the fuel flow rate is precisely controlled by said fifth means.

2. A closed loop fuel control system as claimed in claim 1, wherein each of said integrators comprises an operational amplifier, a resistor interposed in the input line, and a capacitor connected between an input and an output of said operational amplifier, said capacitor functioning as said ninth means.

3. A closed loop fuel control system as claimed in claim 1, wherein said means for supplying an air/fuel mixture is a carburetor having main and slow circuits, each of said main and slow circuits including main and auxiliary air-bleeds.

4. A closed loop fuel control system as claimed in claim 3, wherein said fifth and ninth means respectively comprise first and second actuating means disposed on said auxiliary and main air-bleeds of said each main and slow circuits.

5. A closed loop fuel control system as claimed in claim 4, wherein each of said main air-bleeds comprises a plurality of ports, at least one port being communicated with atmospheric air, while remaining ports are equipped with said second actuating means, said second actuating means comprising a plurality of electromagnetic valves disposed in said remaining ports so as to selectively induce atmospheric air into each port when energized.

6. A closed loop fuel control system as claimed in claim 5, wherein the total cross sectional area of said ports of each of said main air-bleeds is larger than that of each auxiliary air-bleed.

7. A closed loop fuel control system as claimed in claim 1, wherein said sixth means comprises means for detecting the opening degree of the throttle valve disposed in the intake passage of said engine.

8. A closed loop fuel control system as claimed in claim 7, wherein said seventh means comprises means for producing first, second and third signals respectively when the degree of opening of said throttle valve is in first, second and third ranges.

9. A closed loop fuel control system for an internal combustion engine including means for supplying an air/fuel mixture to said engine, comprising:

(a) first means for sensing the concentration of a component contained in the exhaust gases emitted from said engine to produce a first signal indicative of the air/fuel ratio of the air/fuel mixture;

(b) second means for producing a second signal indicative of the difference in magnitude between said first signal and a reference signal;

(c) third means for producing a third signal in response to said second signal, said third means including a proportional-integral controller;

(d) fourth means for producing a control signal in accordance with said third signal;

(e) fifth means for controlling the fuel flow rate in accordance with each control signal;

(f) sixth means for detecting the operational conditions of said engine in accordance with engine parameters, said sixth means producing a fourth signal indicative of an engine operational mode by selecting one from a plurality of modes which are predetermined;

(g) a plurality of storage means connected to said third means for storing said third signal;

(h) seventh means for selectively enabling one of said plurality of storage means in accordance with said fourth signal;

(i) eighth means for producing a second control signal by comparing each output signal of said storage means in magnitude with a plurality of reference signals;

(j) ninth means for selectively supplying each output of said storage means in accordance with said fourth signal to said eighth means; and (k) tenth means for controlling the fuel flow rate in accordance with said control signal, the fuel flow rate being roughly controlled by said tenth means, while the fuel flow rate is precisely controlled by said fifth means.

* * * * *